United States Patent [19]

Mazodier et al.

[11] Patent Number: 4,898,013

[45] Date of Patent: Feb. 6, 1990

[54] INSTALLATION FOR LEVELLING A METAL STRIP

[75] Inventors: Francois Mazodier, Saint-Etienne; René Paulhac, Sorbiers, both of France

[73] Assignee: Clecim, Courbevoie, France

[21] Appl. No.: 215,973

[22] Filed: Jul. 7, 1988

[30] Foreign Application Priority Data

Jul. 8, 1987 [FR] France ..... 87 09715

[51] Int. Cl.[4] ..... B21D 1/02

[52] U.S. Cl. ..... 72/165; 72/205; 72/247

[58] Field of Search ..... 72/164, 165, 160, 205, 72/247, 183

[56] References Cited

U.S. PATENT DOCUMENTS

| | | | |
|---|---|---|---|
| 2,213,507 | 9/1940 | Ungerer | 72/164 |
| 4,683,744 | 8/1987 | Ginzburg et al. | 72/13 |

FOREIGN PATENT DOCUMENTS

| | | | |
|---|---|---|---|
| 67040 | 12/1982 | European Pat. Off. | 72/247 |
| 199017 | 10/1986 | European Pat. Off. . | |
| 11547 | 5/1968 | Japan | 72/165 |
| 47217 | 4/1981 | Japan | 72/205 |
| 29506 | 2/1983 | Japan | 72/247 |
| 53311 | 3/1983 | Japan | 72/247 |
| 46816 | 3/1985 | Japan | 72/164 |

*Primary Examiner*—Daniel C. Crane

*Attorney, Agent, or Firm*—Pollock, Vande Sande & Priddy

[57] ABSTRACT

An installation for levelling a metal strip (3) by advancing it along an undulating path in a levelling stand (10) associated with a plurality of rolls (2, 15, 16, 18) with narrowed ends which may be displaced axially in opposite directions. Narrowed sections (25) are provided at opposite ends of two active levelling rolls (23) (24), and the levelling unit (4) (5) formed by each active roll and associated carrying rollers is mounted on two horizontal beams sliding vertically and associated with jacks (39) (64) for adjusting the axial and vertical position of each levelling unit (4) (5).

3 Claims, 6 Drawing Sheets

INSTALLATION FOR LEVELLING A METAL STRIP

FIELD OF THE INVENTION

The invention relates to a process and an installation for levelling a metal strip which may be used especially for obtaining flat products without edge defects, in particular those which are caused by the fact that the properties, particularly mechanical or metallurgical properties, over a certain width at the edge of the strip are markedly different from those of the central section of the strip.

BACKGROUND OF THE INVENTION

In installations for producing metal products in a strip form, such as thin rolled sheet metal, the product is subjected, after rolling, galvanizing, tinning or another process, to a certain number of finishing operations, to eliminate certain defects. In particular, the strip is passed through a leveller stand which is intended to eliminate twisting caused by the fact that the metal fibers are not of a regular length over the width of the sheet metal. To this end, the sheet metal is advanced on rollers defining an undulating path and subjected to tension, so as to produce elongations by means of traction deflection.

A leveller therefore generally consists of a levelling stand disposed between two tension blocks, one located at the entrance and one at the exit, within which stand are mounted a plurality of levelling rolls, the axes of which are disposed in a staggered arrangement with respect to one another on different levels, so as to define an undulating path.

The levelling stand may also be combined with another device which is located upstream thereof and which has a different function such as, for example, a rolling stand called a "skin-pass" which effects a slight elongation.

By way of example, a conventional type of leveller is represented diagrammatically in FIG. 1. The leveller conventionally comprises two tension blocks at the entrance 11 and at the exit 12 between which a levelling stand 10 is disposed.

Each tension block 11 or 12 comprises a certain number of rollers 13 and 17 which are intended to keep under tension the strip 3 that is being advanced and to confer on it an elongation by appropriate means. The levelling stand 10, disposed between the tension blocks, generally consists of two or four active levelling rolls 2 on which the strip 3, advancing in directions perpendicular to the axes of the rolls, is subjected to traction-deflection distortions in the elastoplastic range.

To this end, the active rolls preferably have a very small diameter relative to their length, and for this reason each of the active rolls 2 is generally placed either on two rollers 21, called intermediate rolls, which rest on three rows of back-up rolls, or directly on two rows of back-up rolls 22, all combinations being possible according to the specifications of the machine. Special stops are provided at the ends of the rolls to enable them to operate satisfactorily. The assembly consisting of an active roll and its carrying rollers is termed "levelling unit".

The levelling unit or units may be followed by devices which are intended to correct a transverse crossbow of the strip or a longitudinal camber; the active rolls of these devices are called: anti-crossbow roll 15 and anti-camber roll 16. These two latter functions are sometimes combined.

Deflector rollers 18, whose number depends on the arrangement of the machine, may be located at different places in order to cause the strip 3 to follow a particular path when passing through the machine, or to perform other functions.

The tangential speed of the rollers 17 of the exit block 12 is greater than that of the rollers 13 of the entrance block 11, so as to subject the strip to an adjustable elongation. Moreover, the positions of the levelling rolls 2, anti-crossbow rolls 15 and anti-camber rolls 16 are adjustable in height relative to the middle plane of advance of the strip, which thus follows a zig-zag path, which may be adjusted. The strip which is subjected to elongation and traction as it passes over each small-diameter active roll, and the adjustment in height of the active rolls, makes it possible to modify the distortion stress applied to the strip. The latter is thus distorted in the plastic range over each active roll, with a wrap angle, by undergoing an elongation, which confers on it the shape of a developable surface, each of the active rolls 14, 15 and 16 performing its own role.

In such installations, all the longitudinal fibers are brought to the same length in the plastic range and, for current materials, all defects in surface evenness, such as "long edges", "long centers", "pockets", etc., may be corrected.

In some cases, in order to improve the effect of correcting the surface evenness, it has already been proposed to provide the ends of certain rolls over which the strip advances with narrowed sections whose diameter progressively decreases relative to that of the central section of the roll so that the path traveled is longer in the central area than at the edges.

By thus causing paths to be traveled which have different lengths in the central area and at the edges of the strip which is subjected simultaneously to distortion in the elastoplastic range, elongations over the central area of the strip are increased during the levelling operation in a manner such that, after leaving the leveller, the fibers all have substantially the same length.

The narrowed sections may be provided at both ends of one and the same roll whose central section, forming the working bed and normally having a constant diameter, covers the central area of the strip over a constant width, the areas of the two edges passing over the two narrowed ends.

The result of this is that a roll of a specific profile may be suitable only for levelling strips whose width varies only to a small degree. Each roll is therefore given a width range and, when a strip of greater or smaller width than the set limits is to be processed, the roll must be replaced with another roll whose narrowed sections are separated from one another by the desired distance.

It is thus necessary to have different levelling rolls with central roll sections of different lengths that each corresponding to a width range, which rolls are exchanged according to requirements. This has drawbacks due, in particular, to the time required for the exchange.

In order to remedy this drawback, the use of rolls provided with a narrowed section at only one end has already been proposed, two successive rolls being equipped with narrowed sections located at opposite ends in a manner such that one edge of the strip passes over the narrowed section of one of the rolls, the other edge passing over the narrowed section of the other roll. By displacing the two rolls parallel to their axis and in opposite directions, on either side of the median longitudinal plane of the strip, it is possible to adjust the distance between the two narrowed sections according to the width of the strip.

However, such an arrangement, which is attractive in principle, creates problems in practice. In fact, even if such an arrangement enables the positioning of the narrowed sections to be adjusted according to the width of the strip, it is necessary to retain the possibility of easily replacing the working rolls, for example in the event of wear. Thus, intervention on the machine leads to a stoppage or, in any case, a curbing of production, and it must therefore be possible to perform this as rapidly as possible given the productivity of current installations which permit strip advance speeds of the order of 800 m/min to be attained.

Moreover, it is necessary to retain the possibility of adjusting the relative heights of the working rolls.

For this reason, it is generally preferred to separate the functions and to provide narrowed ends not on the active levelling rolls but on other rolls, for example the deflecting rollers which are changed less often and whose axial positions are more easily adjusted.

However, passage over the narrowed sections is more effective when the latter are provided on small diameter rolls such as the active roll, over which the strip is subjected to distortion in the plastic range.

However, difficulties in production and installation are then encountered, the more so since there is generally a restricted space available and since it is often necessary to improve existing installations.

SUMMARY OF THE INVENTION

The object of the invention is to propose special arrangements which make if possible to provide narrowed sections on the active levelling rolls while retaining possibilities for adjusting the latter both in height and in the axial direction without substantially increasing the overall size of the levelling stand.

According to the invention, the narrowed sections are therefore provided at opposite ends, respectively, of two asymmetrical active levelling rolls, each resting on carrying rollers, and the levelling units thereby formed by each active roll and the carrying rollers associated with the latter are each mounted, respectively, on an upper beam and a lower beam which are mounted so as to slide vertically on uprights of the housing of the levelling stand and are each associated (a) with height-adjusting means for adjusting the level of the corresponding active roll, and (b) with means for controlling the sliding of the whole levelling unit parallel to the axes of the rolls for adjusting the axial position of the narrowed section one each active roll relative to the axis of the strip.

In a first embodiment of the invention, each asymmetrical roll is mounted with its supporting unit in a frame forming a case mounted so as to be axially movable on the corresponding supporting beam, and the means for adjusting the axial position of each roll consist of jacks resting on the case and on the corresponding beam, respectively.

However, in a preferred embodiment of the invention, the two active asymmetrical rolls, which are each associated with a levelling unit, are fixed on an upper beam and on a lower beam, respectively, which are mounted so as to slide vertically on the uprights of the housing of the stand and are each borne by means of rollers on rails extending horizontally between the two uprights of the stand in a direction transverse to the axis of the strip, so as to allow the vertical displacement of the beam, the adjustment of the axial position of each asymmetrical roll being effected by transverse displacement of the corresponding beam on these supporting rails.

In a particularly advantageously manner, the supporting rollers of the upper beam are mounted in a pair at each end of the beam on arms articulated about horizontal axes enabling the beam with the levelling unit to be towed into a working position, through the action of jacks, and the lifting of the beam into a raised position for disassembly.

Moreover, each supporting beam of a levelling unit with asymmetrical rolls is associated with an axial adjustment device comprising a centering plate mounted so that it can slide perpendicularly to the beam on a carriage mounted so as to slide on slides extending between the two uprights of the housing parallel to the beam, it being possible for the end of the plate to engage in a guide groove provided on the beam in a vertical direction.

By virtue of these arrangements and other features described in detai below, the different elements necessary for adjusting the active rolls in height and for the axial adjustment of the active rolls form a particularly compact assembly which may be housed in a restricted space, this feature being particularly advantageous in the case of small size machines and/or for adapting existing lines.

Moreover, it is necessary to process on levelling machines metal strips which not only have defects of surface evenness but also different properties on the edges relative to the central section of the strip (for example, substantially different limits of elasticiity). This is the case, in particular, with steels known as "full hard".

With such products having a behavior different from current products, the result may be that the final product has a slight residual edge defect caused by these differences in properties, although all the longitudinal fibers have been given the same length in the leveller.

Such defects may also be corrected by virtue of the arrangements according to the invention which make it possible to effect an axial adjustment of quite a substantial extent and, moreover, to provide narrowed sections over a relatively great length at the end of each active roll, in a manner such that each narrowed section covers a lateral area of the strip of a width which is determined according to the defects to be corrected.

It is thus possible to remedy the defects in homogeneity of the strip over its width, and particularly those which may be caused by the existence of markedly different properties at the edges of the strip relative to the central section. The invention also makes it possible to correct a defect caused by such a difference in properties, if necessary on only one edge.

However, the invention may also be useful in the event that the strip, before levelling, has long edges such that it is not possible to correct them totally. In the text which follows, the term "defect" will therefore be used both for excessive long edges of the strip before levelling and for defects caused by different mechanical properties at the edges over a certain width relative to all the central section of the strip, it being understood that it is the correction of the effects of this latter type of defect which is particularly sought after.

BRIEF DESCRIPTION OF THE DRAWINGS

The invention will be better understood by means of the description of certain embodiments which follows and is given by way of example and represented in the appended drawings.

DESCRIPTION OF PREFERRED EMBODIMENTS

Figure 1:
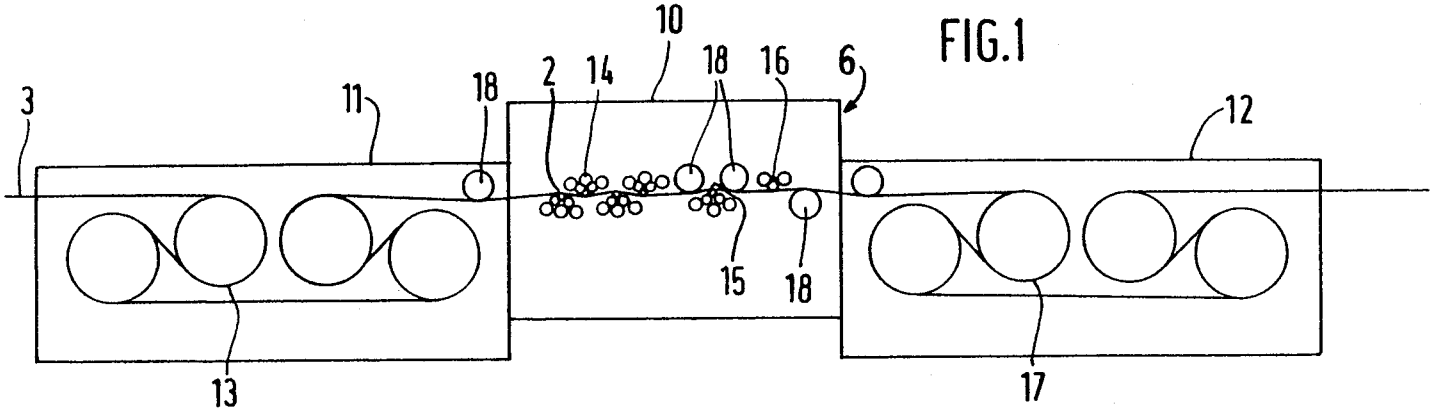
FIG. 1 is a diagrammatic general view of a prior art levelling installation.
Figure 2:
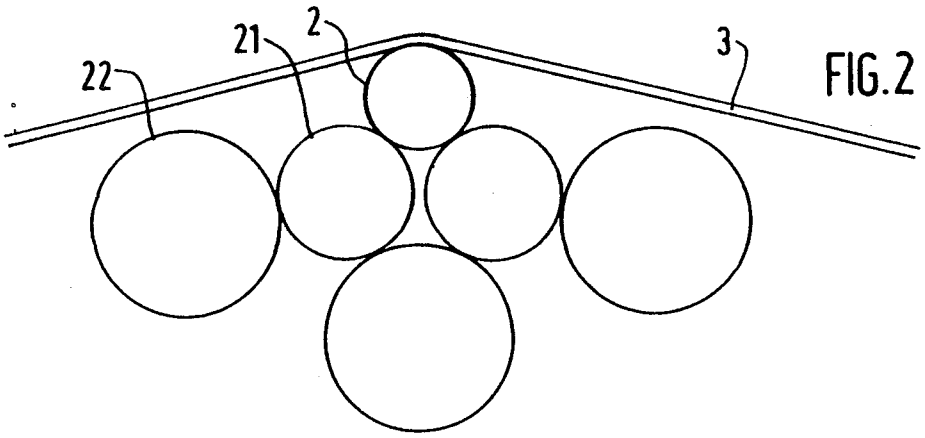
FIG. 2 is a diagrammatic representation of a prior art arrangement of the rolls of a levelling unit.
Figure 3:
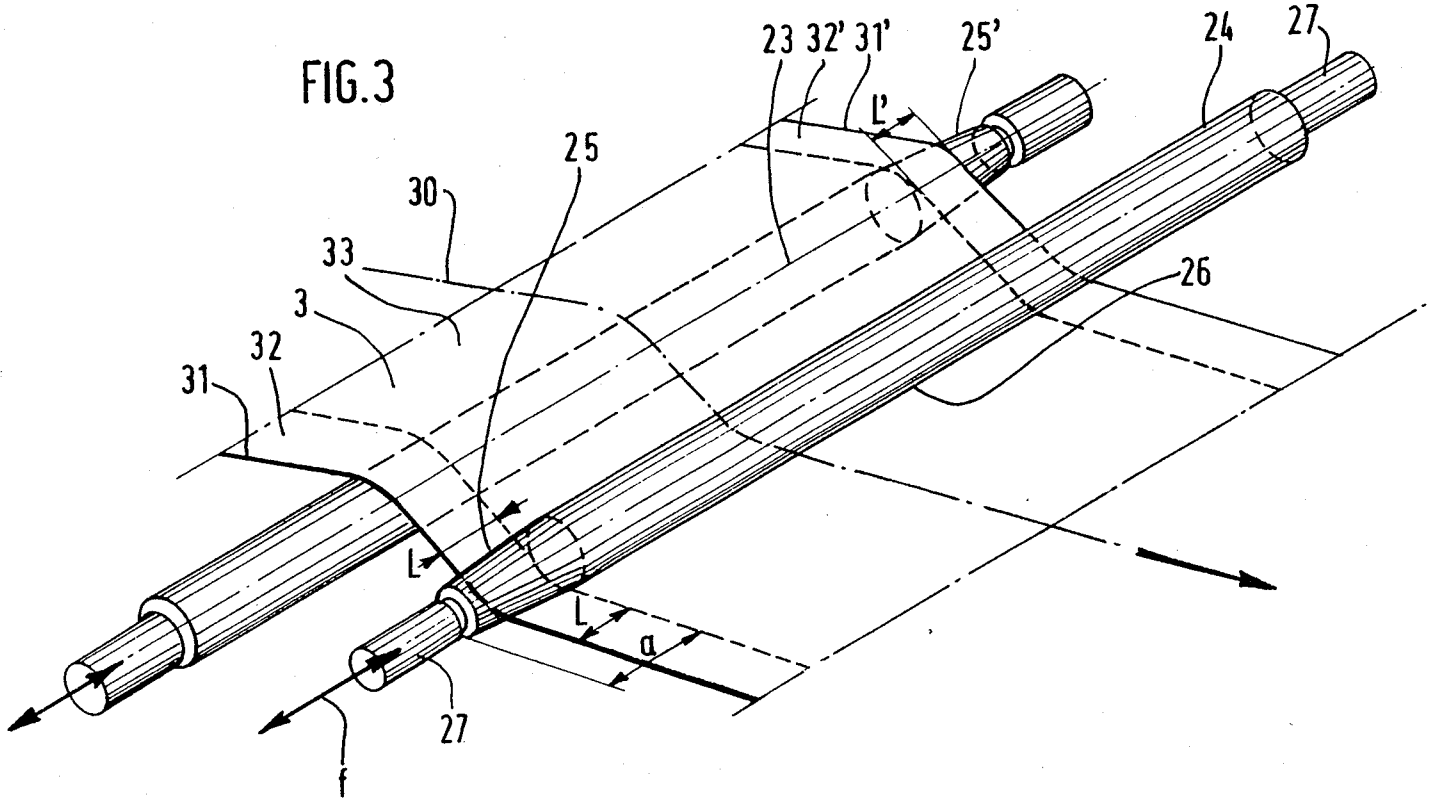
FIG. 3 is a diagrammatic illustration, in perspective, of the principle of the invention.

A conventional levelling installation has already been described above with reference to FIGS. 1 and 2;

FIG. 3 shows diagrammatically in perspective the passage of the strip 3 over two rolls 23, 24 held centered on their axes by means of end pieces 27 and defining an undulating path.

Figure 4:
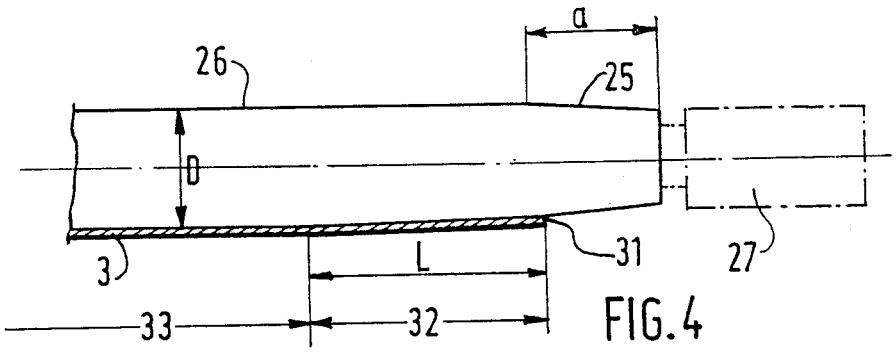
FIG. 4 is a partial view of the end of an active levelling roll.

Two different active rolls, 23 and 24 respectively, of the stand are equipped with an asymmetrical profile, each roll being equipped with a narrowed section 25, 25' at only one of its ends and having a diameter which is substantially constant over the normal section 26 covering the greater part of its length, up to the other end. The narrowed sections 25, 25' are located respectively at two opposite ends of the two rolls 23 and 24, on either side of the longitudinal axis 30 of the strip, and the two rolls 23 and 24 may be displaced in opposite directions parallel to their axis according to the arrows (f) so as to adjust their axial positions so that each narrowed section 25, 25', respectively, is located perpendicular to one of the two edges 31, 31', respectively, of the strip 3. As shown in detail in FIG. 4, each narrowed section 25, 25' having a length a, it is possible axially to adjust the positions of the two rolls so that the diameter D of the roll progressively decreases from a line located at a distance L from the edge 31 of the strip 3. This latter therefore comprises two lateral areas 32, 32' of width L and L' passing over the narrowed sections 25 of the rolls 23 and 24 and framing a central area 33 passing over the roll sections 26 of the two rolls, and it is possible, by acting individually on each of the rolls, to adjust the widths L, and L' respectively, of the two lateral areas 32, 32'.

In FIG. 3, the narrowed sections 25 have a conical shape linked to the roll section 26 by a rounded section, but it would also be possible to provide a different profile, for example a parabolic or similar profile.

Figure 5:
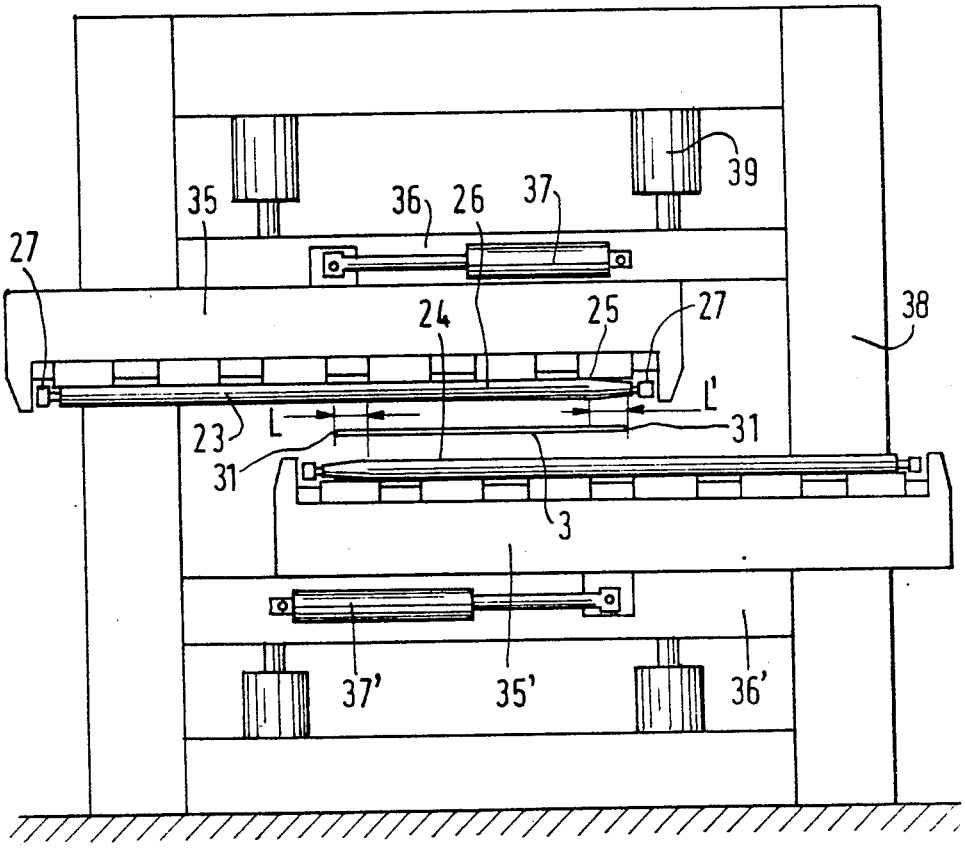
FIG. 5 is a diagrammatic representation of a first embodiment of a levelling stand according to the invention.

FIG. 5 is a diagrammatic representation, by way of example, of a first embodiment of the invention.

Each levelling roll 23, 24 may be located, with the corresponding supporting unit, in a frame 35 forming a case mounted so as to slide axially on a supporting beam 36 on which rests a means for controlling the axial displacement of the case, such as a jack 37.

At least one of the two beams, the upper beam 36 and the lower beam 36' respectively, may be mounted so as to slide vertically in a housing 38 under the action of jacks 39, making it possible to adjust the level in height of the roller and to separate the cases on either side of the plane of the strip 3, in a position for disassembly and reassembly.

Thus the invention makes it possible not only to make precise adjustments to the width of the strip without exchanging the levelling rolls, but also to adjust the position of each edge of the strip over the narrowed section of the corresponding roll and, consequently, to cause a variation in length of the paths traveled over the lateral areas of the strip relative to the central section, by adjusting the relative positions of the narrowed sections 25 relative to the longitudinal axis of advance 30.

It should be noted that the axial displacements of the two levelling rolls 23, 24 do not have to be equal and it is therefore possible, if necessary, to vary the widths L and L' of the lateral areas whose path lengths are modified.

Moreover, it is also posssible to act on the profile of the rolls, for example by modifying the ratio of the respective lengths of the narrowed section 25 relative to the cylindrical section 26 or even by giving the rollers a bulged shape over their entire length.

It will therefore be seen that it is possible to make adjustments in a manner that is very adaptable to requirements, in particular for correcting defects due to the differences in properties in the different areas of the metal strip 3.

Figure 6:
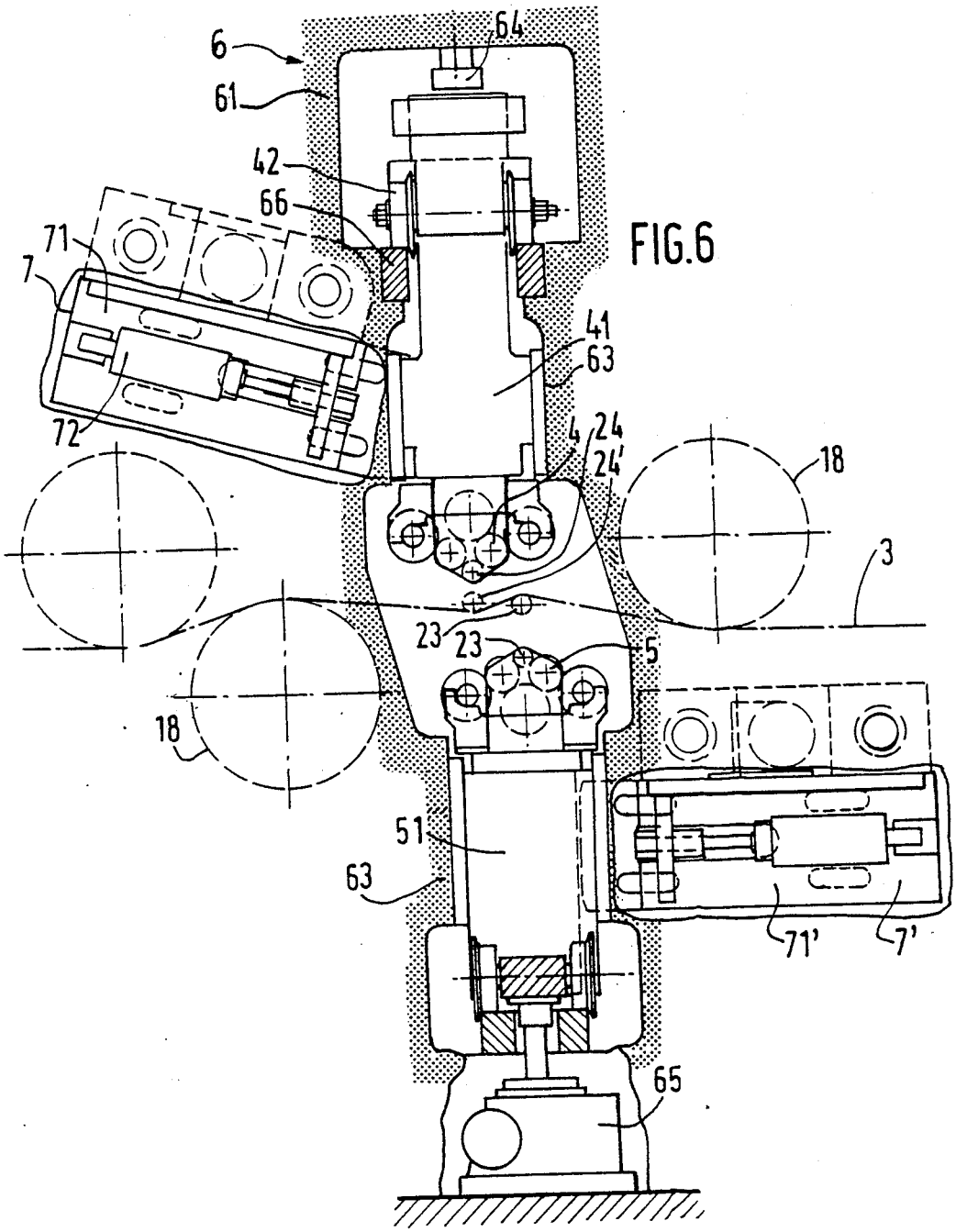
FIG. 6 represents in greater detail another embodiment seen from the operator side, for example, with partial sections.
Figure 7:
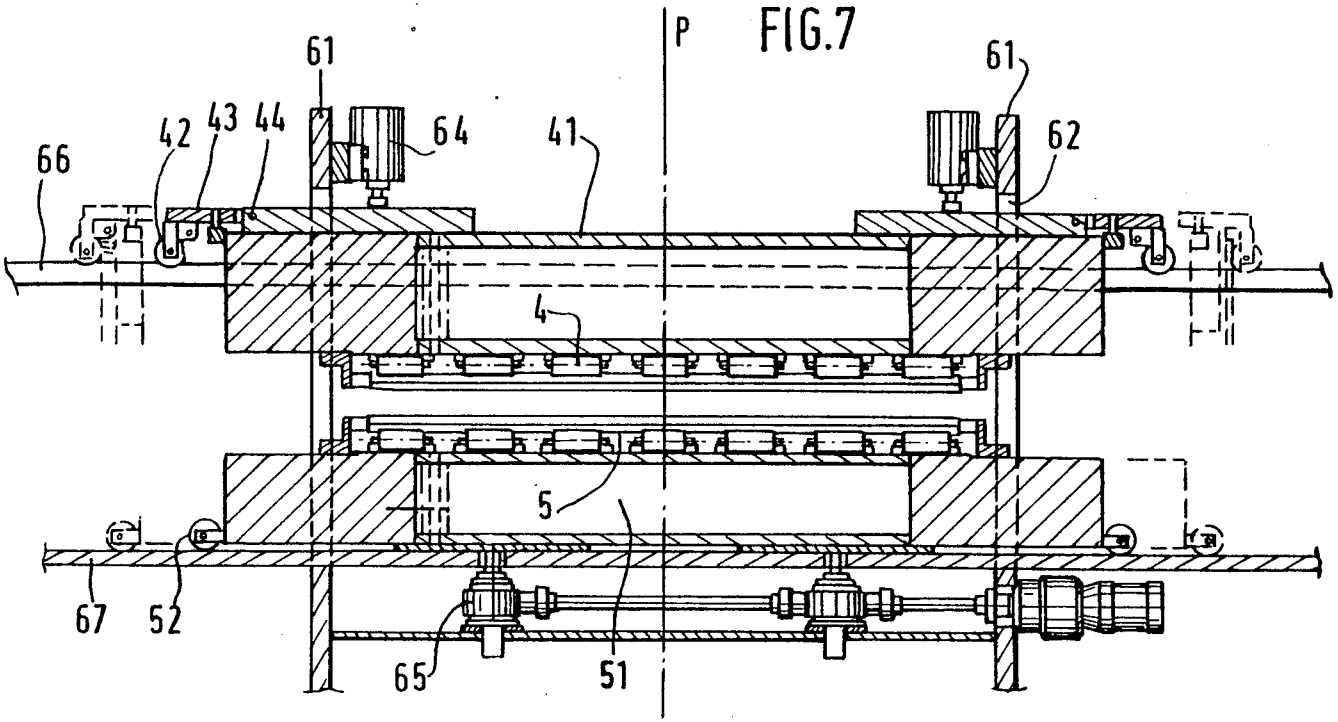
FIG. 7 is a view in cross-section parallel to the axes of the rolls.
Figure 8:
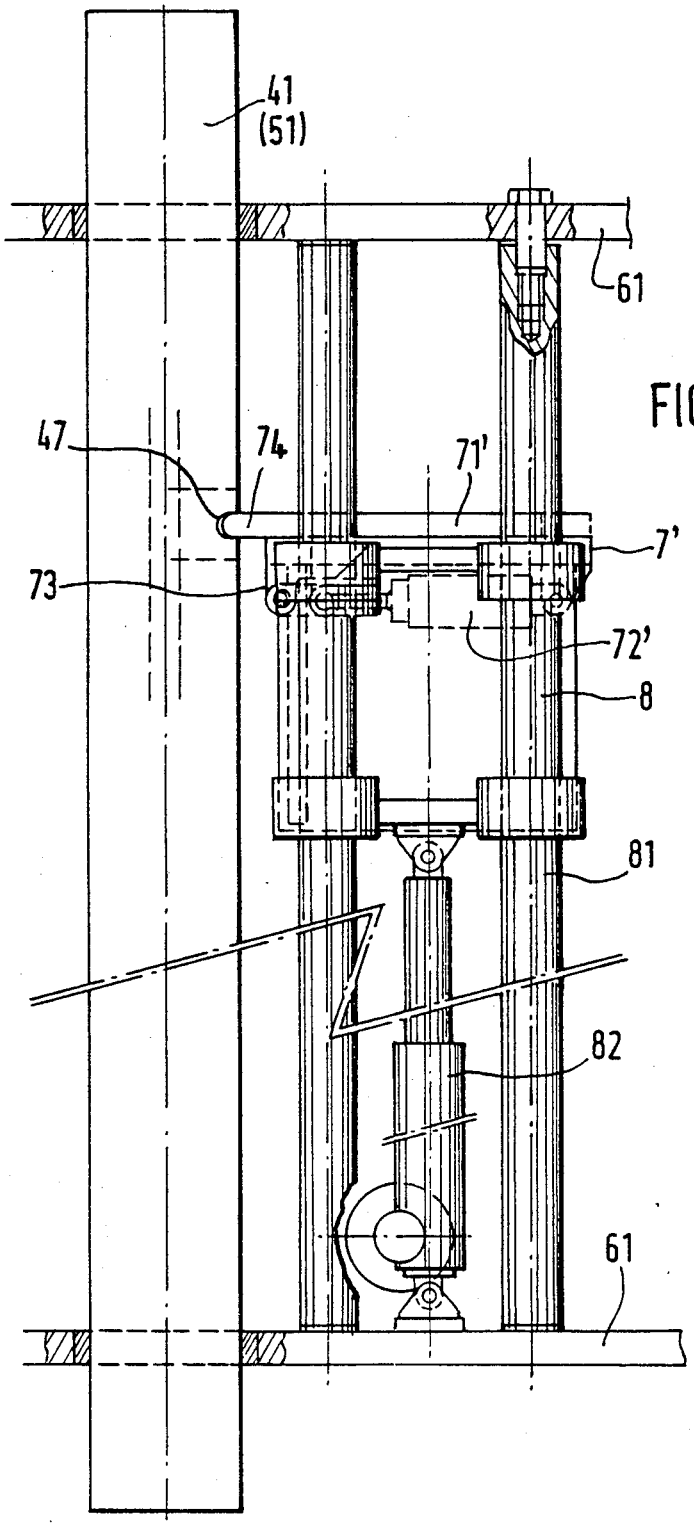
FIG. 8 is a plan view, according to the arrow F of FIG. 6.

In FIGS. 6, 7 and 8, a preferred embodiment of the installation according to the invention has been represented in greater detail by way of example.

The asymmetrical rolls 23 and 24 form part of two levelling units 4 and 5 which are fixed on an upper beam 41 and a lower beam 51, respectively, and which are mounted so as to slide transversely to the axis of advance in a housing 6 comprising, as may be seen in FIG. 6, two uprights 61 within which windows 62 are provided for the passage of the beams 41 and 51.

In working position, the two beams 41 and 51 may also slide vertically along the guide surfaces 63 provided on the uprights 61 of the housing 6. Jacks 64 and 65 control the vertical displacements of the upper beam 41 and of the lower beam 51, respectively. In the example represented, the jacks 64 and 65 are of the hydraulic and electro-mechanical type, but they could be of any other type.

The upper beam 41 is borne by rollers 42 which run on rails 66 extending horizontally in the upper part of the frame 6.

The connection between the beam 41 and the supporting rails 66 is achieved so as to permit the vertical sliding of the beam 41 in a working position under the action of jacks 64 and its return to the level of the rails 66 in a disassembly position.

For example, the rollers 42 may be mounted on sliding frames or on articulated arms of a length which is sufficient to permit the lowering of the levelling roll 24 in the working position represented in dotted lines in FIG. 6.

Such a mobile assembly of the rollers relative to the beams is not indispensable for the beam 51, which may be simply raised by mechanical jacks 65, whose principal role is the correct positioning of the beam, the weight of all the equipment ensuring the return to a low position of the beam 51 which comes to rest on the horizontal rails 67 by means of rollers permitting the axial displacement of the beam 51.

The lower beam may at time also be operated by a hydraulic jack which is added to the mechanical jacks 65 in order to permit rapid opening of the stand from below.

It is therefore possible, when the units 4 and 5 are in a divergent position, to exchange, as usual, a unit by causing each beam 41, 51 to roll horizontally on the rails 66, 67, passing through the windows 62 of the uprights 61 of the frame 6.

The horizontal displacement of each beam 41, 51 to bring it into a working position may be achieved by a mechanism of the jack, automotive carriage, winch, chain or other type (not shown).

On the other hand, adjustment of the axial position of each levelling unit relative to the plane of symmetry P is preferably achieved by centering devices 7 mounted beside each beam 41,51 between the two uprights 61 of the frame 6.

As may be seen in FIG. 8, each centering device 7 is borne by a carriage 8 which slides along slides 81 extending between the two uprights 61 of the housing 6 parallel to the axes of the levelling rolls. A mechanical or hydraulic jack 82 resting on one of the uprights 61 makes it possible to adjust the position of the centering device 7 along the corresponding beam 41.

As may be seen in FIG. 6, a similar device 7' is associated with the lower beam 51.

The centering device 7 (7') comprises a centering plate 71 (71') which is mounted so as to slide on the carriage 8 perpendicularly to the slides 81 and to the axes of the rolls, and whose end 74 may engage in a groove 47 provided on the beam 41 in a vertical direction. The transverse sliding movement of the plate 71 relative to the beam 41 is controlled by a retraction jack 72, the body and the rod of which are articulated, respectively, on the carriage 8 and on a fastening lug 73 solid with the centering plate 71.

When positioning each beam 41 (51), the corresponding centering plate 71 (71') is retracted by the jack 72 so as not to interfere with the passage of the beam (41) (51).

The plate 71 is placed in position opposite the corresponding groove 47 by means of the jack 82, and by means of the jack 72 the plate is engaged in the groove.

The jack 82 then makes it possible, by means of the plate 71, to adjust precisely the axial position of the beam 41 to position exactly the narrowed section of the levelling roll relative to the edge of the sheet metal. The carriage 8 is then held in this position by the jack 82, and the end 74 of the plate 71 forms a guide for the vertical displacement of the beam 41 under the action of jacks 64.

The adjustment of the lower beam 51 is effected in the same manner by the centering device 7'.

The arrangements shown in the drawings normally make it possible to effect the horizontal adjustment of two levelling units only when the stand is in "open" position, the two upper and lower beams being in a high position and in a low position, respectively, so that no load is applied on the rods of the jacks.

However, axial adjustment could also be effected in working position by equipping the clamping jacks with retention devices and/or permitting the sliding of the beams.

It is also possible automatically to control the position of the special rolls as a function of the width of the strip or of that of the lateral defects. The displacement of the rolls as a function of the width of the strip is in principle symmetrical, but the system could also be equipped so as to produce different axial displacements of the rolls.

The order in which the two asymmetrical rolls are placed will be selected as a function of construction requirements and different desired strip paths. One may therefore also choose to apply this correction principle to, for example, two rolls located not on either side of the strip but on the same side relative to a surface of the strip. They also need not be directly adjacent.

Moreover, adjustment of position may be performed whether or not the strip is engaged in the machine, and whether or not it is moving.

We claim:

1. An installation for levelling a metal strip (3) with production of elongations by traction-deflection, by advance of the strip (3) along a longitudinal axis (30) in a levelling stand (10) associated with means (11) (12) for tensioning the strip (3) and comprising, within a housing having two uprights (38), (a) at least two active rolls (23, 24) and at least two deflector rolls (18) rotating around axes which are parallel to one another and perpendicular to a longitudinal axis of advance (30) of the strip, said active rolls (23, 24) being located on different levels on either side of the strip (3) for defining with said deflector rolls (18) an undulating path for the strip (3);

(b) said active rolls (23, 24) each having an asymmetrical profile comprising, at one end, a narrowed section (25) having a diameter which progressively decreases, the two narrowed sections (25) being provided at opposite ends of said asymmetrical active rolls (23, 24) respectively, on either side of the longitudinal axis (30);

(c) each of said asymmetrical active rolls (23, 24) resting on at least two carrying rolls (21) (22);

(d) said active rolls (23, 24) each associated with its carrying rolls (21) (22) respectively forming two levelling units (4) (5);

(e) said levelling units (4) (5) being resepectively mounted each in a frame forming a case (35) (35');

(f) said cases (35) (35') each being slidably mounted parallel to the axes of the rolls, respectively on an upper beam (36) and on a lower beam, (36') said upper and lower beams being mounted to slide vertically on the uprights (38) of said housing;

(g) height-adjusting means (39) (39') respectively associated with said upper beam (36) and lower beam (36') for adjusting the level of the corresponding active rolls (23) (24); and (h) means for controlling the sliding of said levelling units (4) (5) in opposite direction each on the corresponding beam (36) (36') for adjusting the axial position of the narrowed section (25) of each active roll (23) (24) relative to the longitudinal axis (30) of the strip, said means consisting of jacks (37) (37') respectively resting on said upper and lower beams (36) (36') and on the corresponding cases (35) (35').

2. An installation for levelling a metal strip (3) with production of elongations by traction-deflection, by advance of the strip (3) along a longitudinal axis (30) in a levelling stand (10) associated with means (11) (12) for tensioning the strip (3) and comprising, within a frame (6) having two uprights (61), (a) at least two active rolls (23, 24) and at least two deflector rolls (18) rotating around axes which are parallel to one another and perpendicular to a longitudinal axis of advance of said strip, said active rolls (23, 24) being disposed on different levels on either side of the strip (3) to define with said deflector rolls (18) an undulating path for the strip (3);

(b) said active rolls (23, 24) each having an asymmetrical profile comprising, at one end, a narrowed section (25) the diameter of which progressively decreases, the two narrowed sections (25) being provided at opposite ends of said asymmetrical active rolls (23, 24) respectively, on either side of the longitudinal axis (30);

(c) each of said asymmetrical active rolls (23, 24) resting on at least two carrying rolls (21) (22);

(d) said at least two active rolls (23, 24) each associated with its carrying rolls (21) (22) respectively forming at least two levelling units (4) (5);

(e) said levelling units (4) (5) being respectively mounted on an upper beam (41) and a lower beam (51);

(f) windows (62) in the two uprights (61) of the frame (6) for the passage of said upper beam (41) and lower beam (51), said uprights (61) being provided with guide surfaces (63);

(g) means (64) (65) for respectively controlling vertical displacements of the upper beam (41) and of the lower beam (51) along said guide surfaces (63);

(h) upper rails (66) and lower rails (67) extending horizontally between the two uprights (61), respectively in an upper part and a lower part of the frame (6);

(i) said upper beam (41) being borne by said upper rails (66) by means of supporting rollers (42) mounted in pairs at each end of the upper beam (41) on arms (43) articulated about horizontal axes (44) enabling the beam (41) with the levelling unit to be lowered into working position, under the action of jacks (64), and the return of the beam (41) into raised position for disassembly, said arms (43) having a length sufficient to permit lowering of the levelling unit (4) into working position;

(j) means (65) for raising the lower beam (51) to place the levelling unit (5) in its working position, said lower beam (51) resting in a low position on said lower rails (67) by means of rollers (52);

(k) two axial adjustment devices (7) (7') respectively associated with each of said upper and lower beams (41) (51) to enable transverse displacements of said beams (41) (51) in opposite directions on the corresponding rails (66) for adjusting the axial position of the narrowed section (25) of each active roll (23) (24) relative to the longitudinal axis (30) of advance of the strip;

(l) each axial adjustment device (7) cooperating with a guide part (47) provided on the corresponding beam (41) (51) for guiding said beams (41) (51) in a vertical direction.

3. An installation as claimed in claim 2, wherein each supporting beam (41) (51) for a levelling unit (4) (5) with an asymmetrical roll (23) (24) is associated with an axial adjustment device (7) comprising a centering plate (71) mounted so that it can slide perpendicularly to the beam on a carriage (8) mounted so as to slide on slides (81) extending between the two uprights (61) of the housing (6) parallel to the beam (41) (51), it being possible for the end (72) of the plate (71) to engage in a guide groove (47) provided on the beam (41) (51) in a vertical direction.

* * * * *